US007062883B1

(12) United States Patent
Langholz et al.

(10) Patent No.: US 7,062,883 B1
(45) Date of Patent: Jun. 20, 2006

(54) SELF GUYING COMMUNICATION TOWER

(75) Inventors: Laurence H. Langholz, Tulsa, OK (US); Robert C. Brothers, Tulsa, OK (US)

(73) Assignee: AllTech Communications, L.L.C., Tulsa, OK (US)

( * ) Notice: Subject to any disclaimer, the term of this patent is extended or adjusted under 35 U.S.C. 154(b) by 754 days.

(21) Appl. No.: 09/812,121

(22) Filed: Mar. 16, 2001

(51) Int. Cl.
*E04H 12/18* (2006.01)
*E04H 12/00* (2006.01)

(52) U.S. Cl. ..... 52/110; 52/125.2; 52/146; 52/40

(58) Field of Classification Search ..... 52/29, 52/146, 125.2, 40, 110, 148, 151; 280/765, 280/764, 766
See application file for complete search history.

(56) References Cited

U.S. PATENT DOCUMENTS

| | | | | | |
|---|---|---|---|---|---|
| 544,577 | A | | 8/1895 | Greve | |
| 1,360,493 | A | | 11/1920 | Breden | |
| 2,742,260 | A | * | 4/1956 | Patterseon | 52/741 |
| 2,863,530 | A | | 12/1958 | Woolslayer et al. | |
| 2,905,280 | A | | 9/1959 | Weaver | 189/15 |
| 2,922,501 | A | * | 1/1960 | Wilson | 52/148 |
| 2,973,818 | A | | 3/1961 | Marvin | 172/456 |
| 3,289,364 | A | | 12/1966 | Watts, Jr. et al. | 52/117 |
| 3,561,711 | A | * | 2/1971 | Dodge | 248/163 |
| 4,011,694 | A | | 3/1977 | Langford | 52/1 |
| 4,320,607 | A | * | 3/1982 | Eubank | 52/143 |
| 4,482,287 | A | * | 11/1984 | Menzi | 414/694 |
| 4,555,031 | A | * | 11/1985 | Blasé et al. | 212/189 |
| 4,899,500 | A | | 2/1990 | Miller et al. | 52/146 |
| 5,025,606 | A | * | 6/1991 | McGinnis et al. | 52/741 |
| 5,244,346 | A | * | 9/1993 | Fergusson | 416/142 |
| 5,961,145 | A | * | 10/1999 | Schillinger et al. | 280/764.1 |
| 5,997,176 | A | * | 12/1999 | Fairleigh | 378/196 |
| 6,616,243 | B1 | * | 9/2003 | Russell et al. | 298/17 SG |

FOREIGN PATENT DOCUMENTS

| | | | | |
|---|---|---|---|---|
| JP | 255161 | * | 10/1988 | 280/764.1 |
| JP | 305061 | * | 12/1988 | 280/764.1 |
| JP | 99794 | * | 4/1994 | 280/763.1 |
| JP | 135305 | * | 5/1994 | 280/764.1 |

* cited by examiner

*Primary Examiner*—Lanna Mai
*Assistant Examiner*—Phi Dieu Tran A
(74) *Attorney, Agent, or Firm*—Head, Johnson & Kachigian

(57) ABSTRACT

A mobile communication tower comprising a trailer comprising a chassis, mounted on two or more wheels, a hitch, a plurality of chassis guy wire attachment points and a plurality of leveling mechanisms; a telescopic tower pivotally mounted on the trailer; a mechanism to raise and lower the tower; a plurality of tower guy wire attachment points located on the tower; and a plurality of guy wires each with an upper end attached to one of the tower guy wire attachment points and a lower end attached to one of the chassis guy wire attachment points.

8 Claims, 4 Drawing Sheets

SELF GUYING COMMUNICATION TOWER

REFERENCE TO PENDING APPLICATIONS

This application is not related to any pending applications.

REFERENCE TO MICROFICHE APPENDIX

This application is not referenced in any microfiche appendix.

TECHNICAL FIELD OF THE INVENTION

The present invention is in the field of temporary mobile communication facilities.

BACKGROUND OF THE INVENTION

In the last few years the popularity of cellular phones, digital pagers, wireless Internet access and digital telephone service has increased dramatically. In order to provide these communication services the service providers must maintain a network of towers spread across the area of coverage. Since what these service providers sell is air time, it is very important that these providers place a tower and equipment quickly in any location where insufficient capacity exist. Temporary facilities play an important role in providing the service provider a mechanism with which they can provide coverage to meet such demand. When there is insufficient coverage to meet standard usage requirements, a temporary facility may be used while a permanent site is built. From time to time these towers are taken out of service for routine maintenance or due to damage caused by storms or accidents. When the towers are taken out of service this forces the service provider to either have a gap in coverage or to obtain temporary facilities to provide services. Temporary facilities are also useful in providing cellular capacity necessary to cover increased temporary demand due to a large sporting event, celebration or festival.

Purported improvements to portable towers are known and represented in the prior art. For example:

U.S. Pat. No. 544,577 issued on Aug. 13, 1895 to J. B. Greve discloses a fence post.

U.S. Pat. No. 1,360,493 issued on Nov. 30, 1920 to O. W. Breden discloses a distributing apparatus.

U.S. Pat. No. 2,863,530 issued on Dec. 9, 1958 to H. J. Woolslayer et al. discloses a portable oil well derrick U.S. Pat. No. 2,905,280 issued on Sep. 22, 1959 to S. M. Weaver discloses a telescoping or collapsible brace construction U.S. Pat. No. 2,973,818 issued on Mar. 7, 1961 to G. I. N. Marvin discloses a wheeled trailer for liquid fertilizer applying apparatus.

U.S. Pat. No. 3,289,364 issued on Dec. 6, 1966 to H. B. Watts Jr. et al. discloses a composite tower structure and method of tower erection and storage.

U.S. Pat. No. 4,011,694 issued on Mar. 15, 1977 to Frederic E. Langford discloses a method and apparatus for guying a load bearing member wherein a system for guying a tower on which a force is exerted in a direction transverse to the elongate dimension thereof includes a plurality of guys interconnected between the tower and respective anchors. The guys are placed under a tension load to oppose the force exerted on the tower. An extensible device, such as a hydraulic piston and cylinder assembly, is serially interconnected with the guys at a location between the tower and the anchor. Before a force is exerted on the tower, the piston and cylinder assemblies are pre-pressurized with hydraulic fluid so as to retract the pistons and thus reduce the effective length of the guys. When the load on the guy bearing the greatest tension load reaches a predetermined value, hydraulic fluid is relieved from its associated piston and cylinder assembly, allowing the assembly to extend and increase the effective length of that guy. As this occurs, the tower will translate in the direction of the load exerted thereon, transferring a portion of the tension load that would otherwise be borne by the guy bearing the greatest load to the remaining guys. The tension load at which the piston and cylinder assembly extends is predetermined so as to prevent the tension load per unit cross sectional area of its associated guy from exceeding the ultimate strength of that guy.

U.S. Pat. No. 4,899,500 issued on Feb. 13, 1990 to Harmon R. Miller et al discloses a CMR (Cellular Mobile Radiotelephone) cell site which includes a foundation for a CMR equipment edifice. The foundation, together with the edifice, rests on a leveled surface. An antenna tower is mounted on the roof of the edifice and is secured by an antenna mounting brace embedded in the roof of the edifice. The antenna is guyed at three elevations along the antenna's height to three points on the foundation. The edifice encloses a 10-inch-square, steel support column, positioned within the edifice directly beneath the antenna mounting brace, for supporting the antenna tower. Four-inch-thick slabs of concrete are inserted between the floor of the edifice and the support column and between the support column and the roof so as to isolate the interior of the building from electrical disturbances such as lightening.

BRIEF SUMMARY OF THE INVENTION

The present invention is a trailer mounted mobile communications tower which is capable of being erected and guyed without use of standard terrestrial anchors.

The tower itself is a telescopic tower which rides on a trailer. When the trailer is put into place, the outriggers are deployed. The tower is then elevated to its normal operating height where the guy wires are secured from the tower guy wire attachment points down to the chassis guy wire attachment points.

At first, the present invention may appear similar to U.S. Pat. No. 4,899,500 (the '500 patent). However, upon a closer inspection, the present invention is very different from the '500 patent. The '500 patent purports to be a mobile site. However, the unit disclosed in the '500 patent weighs 54,000 pounds and requires a separate crane to be brought on site for the building to be placed in position on the foundation, making it in reality a permanent facility. The crane is also required to erect the tower which is transported to the site in various segments. The present invention on the other hand is always mounted on at least one axle and can be deployed and put into place by using a pickup truck. The tower itself is erected by using the lifting mechanism built onto the trailer. Furthermore, the device disclosed in the '500 patent is constructed using two 4" thick slabs of concrete. It also has a building mounted on the foundation. The present invention, while it may or may not have an equipment cabinet or shelter attached to the trailer, does not have any concrete in its construction.

It should also be noted that the present invention can be deployed and set up within thirty minutes whereas it takes at least 36 hours to erect the system disclosed in the '500 patent.

Another difference between the '500 patent and the present invention is that the invention disclosed in the '500 patent relies upon its 54,000 pounds of weight to act as an anchor to provide stability for the tower whereas the present invention weighs approximately 8,000 pounds although this weight can vary with the equipment and accessories added to the present invention.

Furthermore, it is important to note that the '500 patent specifically teaches away from using a trailer to transport the tower and implies that the large weight is necessary to provide a stable platform. This is a direct contradiction to the present invention which is trailer mounted and weighs significantly less than the device disclosed in the '500 patent.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

Figure 1:
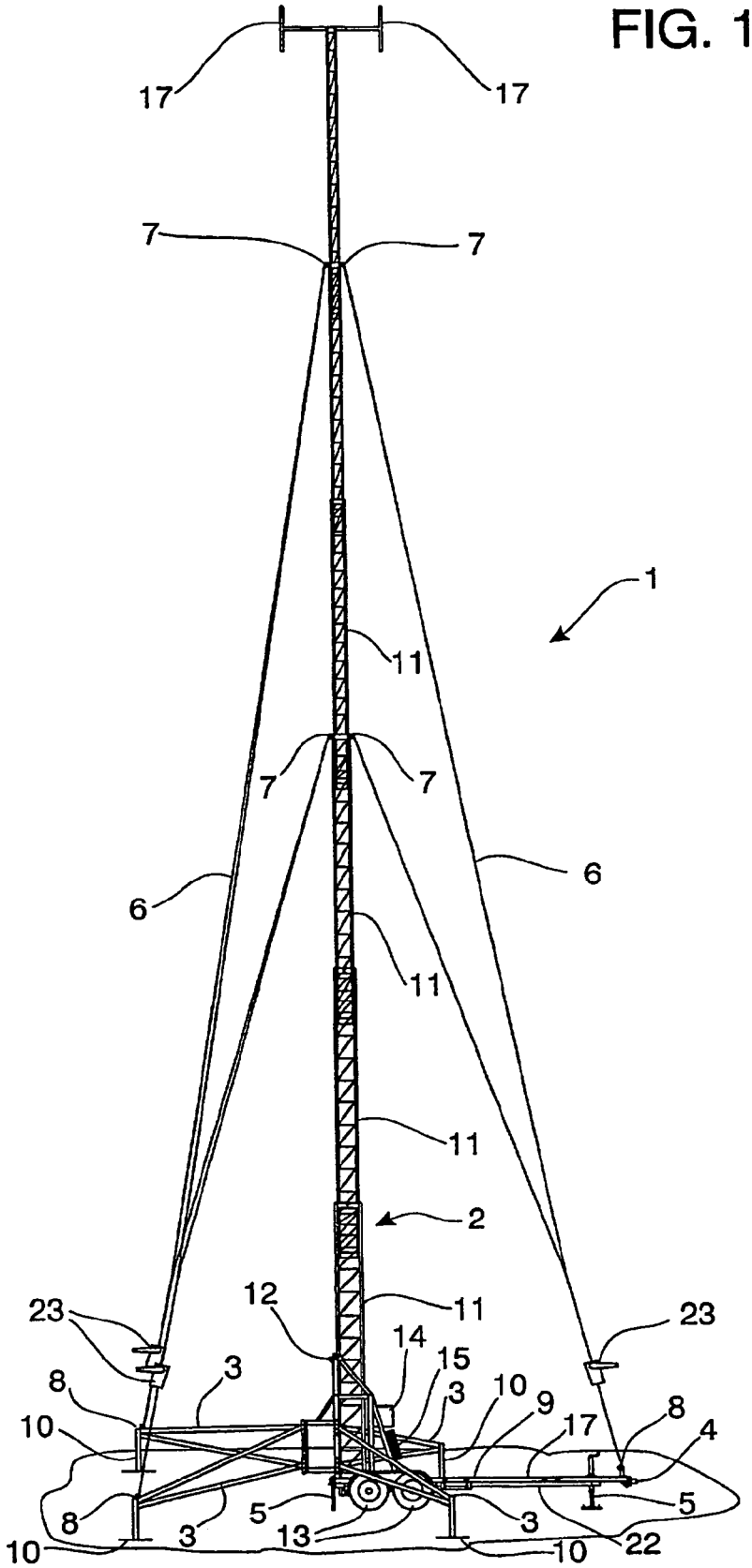
FIG. 1 is a side view of the fully erected tower containing the present invention.

FIG. 1 shows a side view of a trailer mounted telescopic communication tower with one embodiment of the present invention in a fully erected position. The tower 2 is comprised of a plurality of telescoping tower sections 11 which can nest inside one another in the down position and can be telescopically extended to reach the up position. Located at the top of the tower 2 are the antenna mounts 17. The tower 2 is pivotally mounted to a trailer 9 at the tower pivot point 12. The trailer 9 is comprised of a chassis 22, outriggers 3, wheels 13, a plurality of leveling mechanisms 5, and a hitch 4.

The plurality of outriggers 3 are pivotally mounted at one end to the chassis 22. At the outer end of each outrigger 3 is located a outrigger foot 10. The outrigger foot 10 can be adjusted up or down to help level the trailer 9. The leveling mechanisms 5 also assist in leveling the trailer 9.

The trailer 9 also has a spare tire 15 and a cabinet 14 to contain various equipment.

There is a chassis guy wire attachment point 8 located near the hitch 4 and on each of the outriggers 3. There are also tower guy wire attachment points 7 mounted on a plurality of places on the tower 2. The upper end of the guy wires 6 are attached to the tower guy wire attachment points 7 while tower 2 is in the lowered position. The tower 2 is then fully erected and the lower end of the guy wires 6 are connected to the chassis guy wire attachment points 8. The guy wires 6 are then tensioned to secure the tower 2 into a vertical position. The exact location of the tower guy wire attachment points 7 and the chassis guy wire attachment points 8 can be adapted to suit current field conditions. The exact mechanism by which the guy wires 6 are attached and tensioned can be any one of a number of mechanisms which are commonly used in this art.

Figure 2:
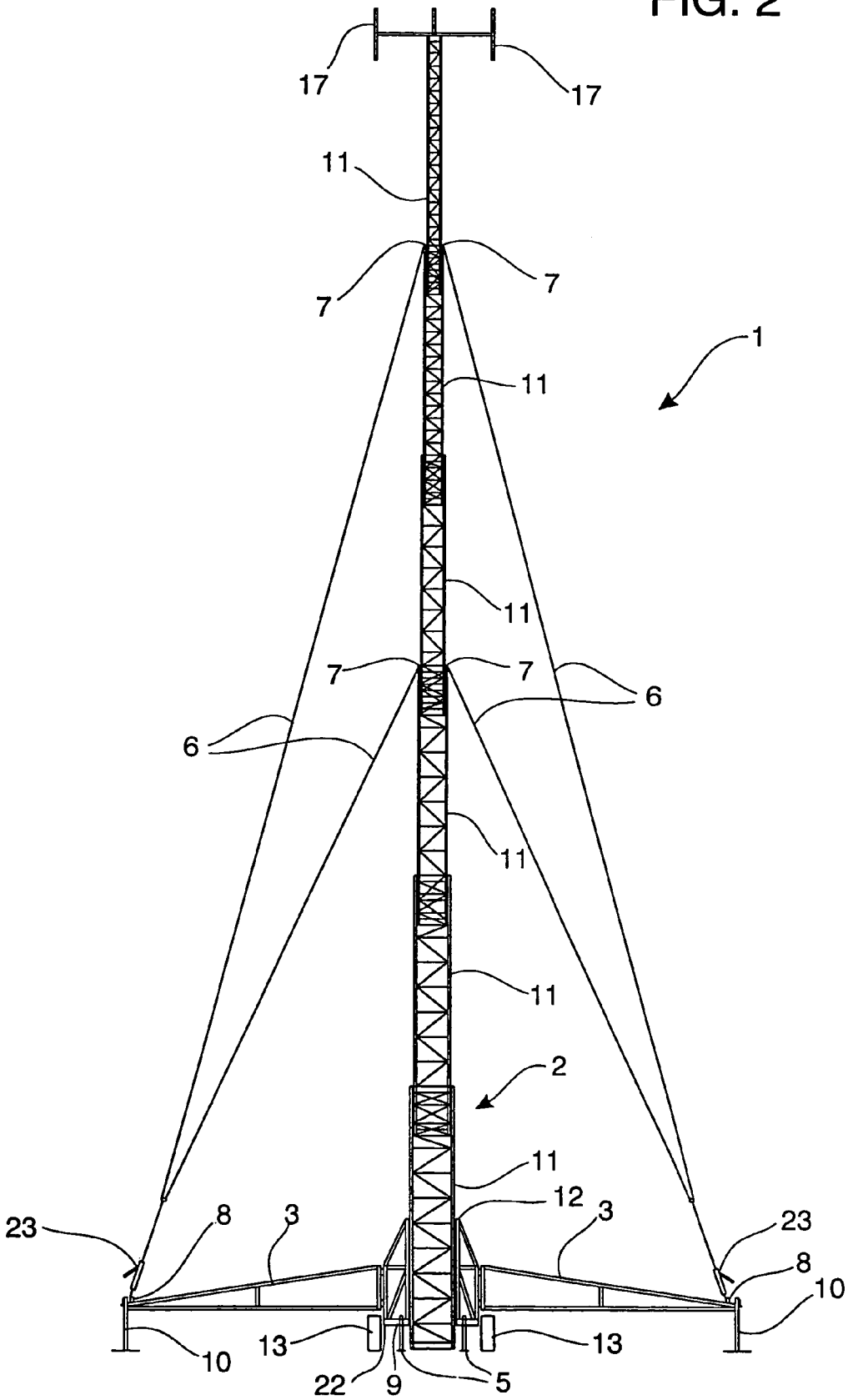
FIG. 2 is an end view of the fully erected tower containing the present invention.
Figure 3:
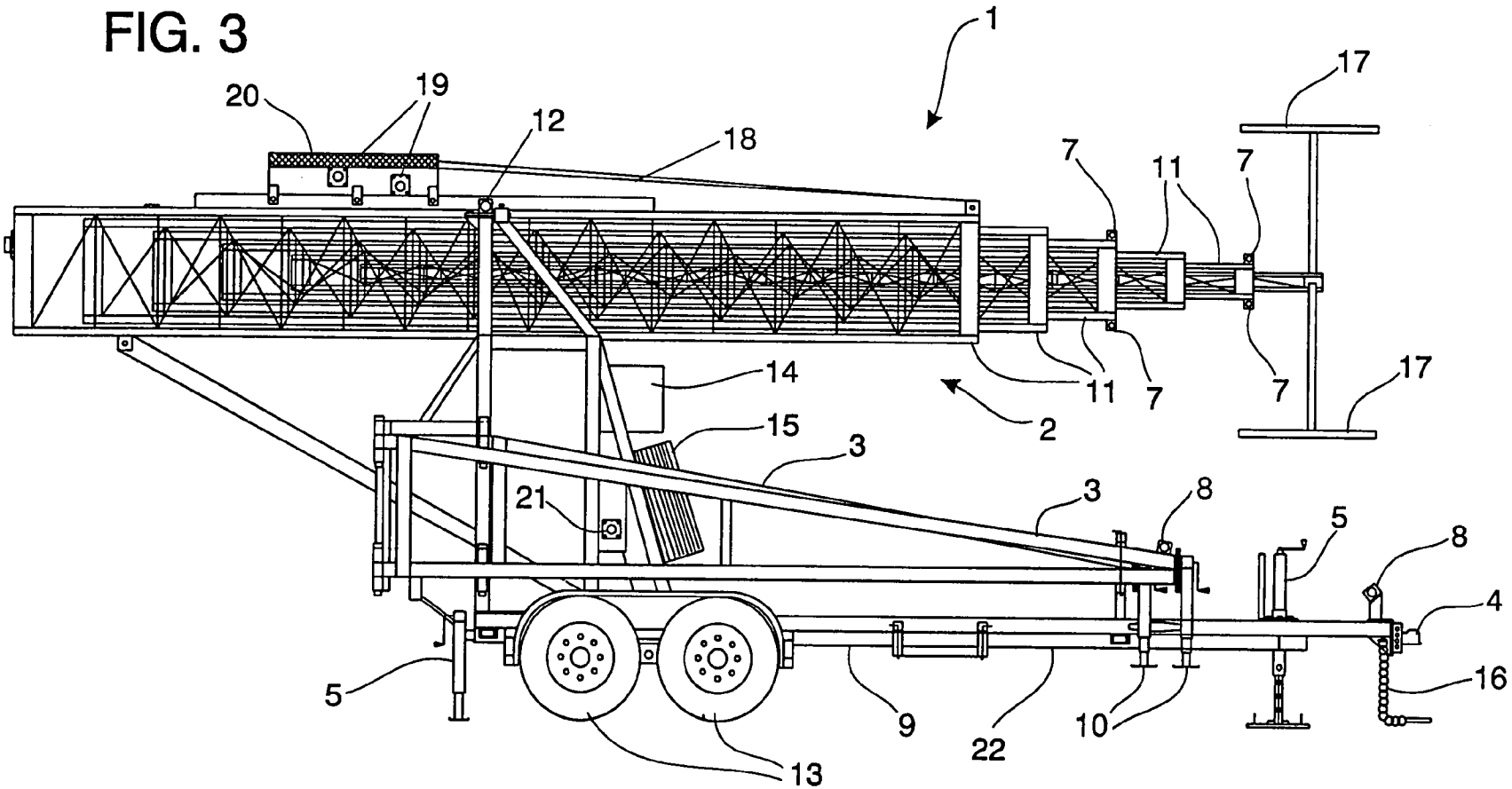
FIG. 3 is a side view of the tower ready for transport.

The tower 2 is pivotally mounted to the trailer 9 at the tower pivot 12. There is a tilting mechanism 21 which manipulates the collapsed tower from a horizontal position to a vertical position. A lifting mechanism 20 is used to extend the tower to a fully erect position. The embodiment of the trailer mounted telescopic communications tower 1 as shown in FIGS. 1 through 3 has two lifting winches 19 each with a lifting cable 18. In the event one of the lifting mechanisms fails, the tower can be erected or collapsed using the second lifting mechanism. Other types of lifting mechanisms 19 are pneumatic or hydraulic in nature and are commonly used in this art.

To use the trailer mounted telescopic communication tower 1, the trailer 9 is pulled onto a site. The forward most leveling jack 5 is then lowered and the hitch 4 and safety chain 16 are disconnected from the tow vehicle. The two rearmost leveling mechanisms 5 are then also lowered. All of the leveling mechanisms 5 are then manipulated to put the trailer 9 on a level plane. Once the trailer 9 is on a level plane, the outriggers 3 are deployed and the outrigger feet 10 are lowered. The outrigger feet 10 are then adjusted to insure that the trailer 9 remains on a level plane. The tower 2 is then tilted to a vertical position using the tilting mechanism 21. Once the collapsed tower 2 is in a vertical position, the communication equipment is mounted on the mounts 17 and on various other parts of the tower 2. Also the upper ends of the guy wires 6 are connected to the tower guy wire attachment points 7. The tower 2 is then erected by the lifting winch 19, winching in the lifting cables 18. Once the tower reaches the desired height, the lifting winch 19 is then stopped. The lower ends of the guy wires 6 are then connected to the chassis guy wire attachment points 8. The guy wires 6 are then tensioned until the tower 2 is plumb. The trailer mounted telescopic tower 1 is then ready for use once it is connected to the system.

Figure 4:
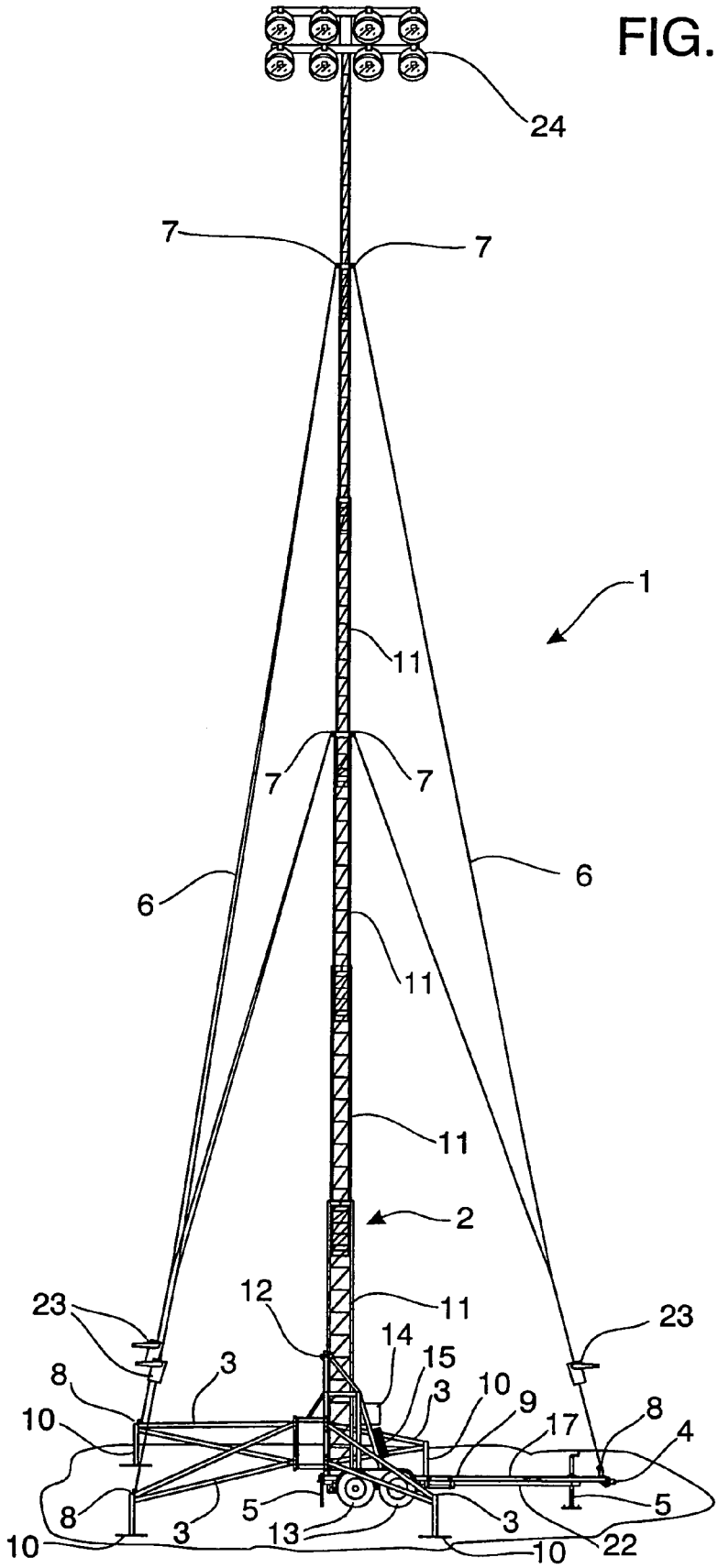
FIG. 4 is a side view of the fully erected tower containing the present invention in use with a lighting assembly.

The present invention of erecting a mobile tower and anchoring its guy wires to the trailer 9, chassis 20 or outriggers 8 can also be applied to lighting towers as shown in FIG. 4. The trailer mounted telescopic tower 1 has a lighting assembly 24 mounted on it. In this application the antenna mounts 17 are replaced with a lighting assembly 24.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A mobile communication tower comprising:

a trailer comprising a chassis mounted on two or more wheels, a hitch, a plurality of chassis guy wire attaching points and a plurality of leveling mechanisms wherein the chassis has a plurality of outriggers pivotally mounted to said chassis, each outrigger having an outrigger guy wire attaching point and a foot which can be adjusted vertically, wherein the lower end of each guy wire is attached to an outrigger guy wire attaching point, a telescopic tower pivotally mounted on the trailer, a mechanism to raise and lower the tower, a plurality of tower guy wire attaching points located on the tower, and a plurality of guy wires each with an upper end attached to one of the tower guy wire attaching points and a lower end attached to one of the chassis guy wire or outrigger guy wire attaching points.

2. A method for stabilizing a mobile communications tower comprising the steps of:

leveling a trailer having a chassis mounted on two or more wheels, a hitch, and a plurality of chassis guy wire attaching points;

moving a tower pivotally mounted to a chassis on a trailer from a horizontal to a vertical position;

moving a plurality of outriggers pivotally mounted on said chassis from a retracted to an extended position;

attaching upper ends of a plurality of guy wires to the erected tower, attaching the lower ends of the plurality of guy wires to the chassis of the trailer and tightening the plurality of guy wires.

3. A mobile lighting tower comprising:

a trailer comprising a chassis, mounted on two or more wheels, a hitch, a plurality of chassis guy wire attaching points and a plurality of leveling mechanisms wherein the chassis has a plurality of retractable outriggers mounted on said chassis, each outrigger having an outrigger guy wire attaching point and a foot which can be adjusted vertically, wherein the lower end of each guy wire is attached to an outrigger guy wire attaching point, a telescopic tower pivotally mounted on the trailer, a mechanism to raise and lower the tower, a plurality of tower guy wire attaching points located on the tower, and a plurality of guy wires each with an upper end attached to one of the tower guy wire attaching points and a lower end attached to one of the chassis guy wire or outrigger guy wire attaching points.

4. A method for stabilizing a mobile lighting tower comprising the steps of:

leveling a trailer having a chassis mounted on two or more wheels, a hitch, and a plurality of chassis guy wire attaching points;

moving a tower pivotally mounted to a chassis on a trailer from a horizontal to a vertical position;

moving a plurality of outriggers pivotally mounted on said chassis from a retracted to an extended position; and attaching upper ends of a plurality of guy wires to the erected tower, attaching the lower ends of the plurality of guy wires to the chassis of the trailer and tightening the plurality of guy wires.

5. A mobile communication tower as set forth in claim 1 wherein said pivotally mounted outriggers swing radially.

6. A mobile communication tower as set forth in claim 1 wherein said outriggers pivotally mounted to said chassis pivotally move about an axis parallel to said tower.

7. A mobile lighting tower as set forth in claim 3 wherein said outriggers swing radially.

8. A mobile lighting tower as set forth in claim 3 wherein said outriggers pivotally move about an axis parallel to said tower.

* * * * *